US006735923B1

(12) United States Patent
Resta

(10) Patent No.: US 6,735,923 B1
(45) Date of Patent: May 18, 2004

(54) MATTRESS PACKAGING MACHINE INCLUDING AN AUTOMATIC ROLL REPLACEMENT DEVICE

(75) Inventor: Roberto Resta, Faenza (IT)

(73) Assignee: Resta S.r.l., Faenza (IT)

( * ) Notice: Subject to any disclaimer, the term of this patent is extended or adjusted under 35 U.S.C. 154(b) by 0 days.

(21) Appl. No.: 09/677,763

(22) Filed: Oct. 3, 2000

(30) Foreign Application Priority Data

Oct. 19, 1999 (IT) ..... BO99A0560

(51) Int. Cl.[7] ..... B65B 57/02; B65B 41/00
(52) U.S. Cl. ..... 53/64; 53/389.2; 53/228
(58) Field of Search ..... 53/64, 550, 547, 53/228, 387.1, 230, 229, 389.2, 389.3

(56) References Cited

U.S. PATENT DOCUMENTS 2,894,363 A * 7/1959 Voogd ..... 53/228
3,910,005 A * 10/1975 Thimon et al. ..... 53/397
4,905,457 A 3/1990 Bene
5,429,698 A * 7/1995 Hartman et al. ..... 156/250
5,501,066 A * 3/1996 Errasti Iriarte et al. ..... 53/556
5,857,391 A * 1/1999 Renstrom ..... 82/101

FOREIGN PATENT DOCUMENTS

| | | |
|---|---|---|
| DE | 25 06 932 | 9/1976 |
| EP | 0 939 031 | 9/1999 |
| FR | 2 208 377 | 6/1974 |
| WO | 97 12809 | 4/1997 |

* cited by examiner

*Primary Examiner*—Rinaldi I. Rada
*Assistant Examiner*—John Paradiso
(74) *Attorney, Agent, or Firm*—Guido Modiano; Albert Josif; Daniel O'Byrne

(57) ABSTRACT

A mattress packaging machine with an automatic roll replacement device for automatically replacing a roll for feeding a sheet for wrapping the mattress, having: a horizontal frame upon which the mattress slides; a sheet guiding mechanism so the sheet is arranged over and under the mattress; a sheet joiner and cutter after the mattress is wrapped; a sliding carriage with feed roll supporting assemblies for unwinding and takeup of a respective sheet and with a transferable take-up roll with which an end of the sheet is connected.

10 Claims, 8 Drawing Sheets

MATTRESS PACKAGING MACHINE INCLUDING AN AUTOMATIC ROLL REPLACEMENT DEVICE

BACKGROUND OF THE INVENTION

The present invention relates to a device for automatically changing the roll for feeding the sheet in which mattresses and the like are wrapped in packaging machines.

Mattress packaging machines are known which comprise a horizontal surface for conveying the mattress to be wrapped and in which a sheet for packaging the mattress, drawn from a roll, is guided at right angles thereto. As the mattress advances, the sheet is folded and laid over and under it so as to form a bag which is then closed to the rear and laterally by heat-sealing.

When the roll is empty, it is replaced with another full one. However, the time required for this replacement is currently excessively long and leads to downtimes which have a negative effect on the production cycle. Moreover, it is often necessary to replace the feeding of one sheet with the feeding of another sheet having different characteristics in terms of quality, color and the like or bearing indications on a different type of packaged mattress.

SUMMARY OF THE INVENTION

The aim of the present invention is to provide a device which allows to automate the replacement of the empty roll with a new one, so as to increase the efficiency of mattress packaging machines or to replace the packaging sheet with another one having different characteristics in relation to the prerogatives and intended uses of the mattress.

This aim is achieved with a device whose characteristics are defined in the appended claims.

BRIEF DESCRIPTION OF THE DRAWINGS

Further characteristics and advantages of the present invention will become better apparent from the following detailed description of an embodiment thereof, illustrated only by way of non-limitative example in the accompanying drawings, wherein.

DESCRIPTION OF THE PREFERRED EMBODIMENTS

Figure 1:
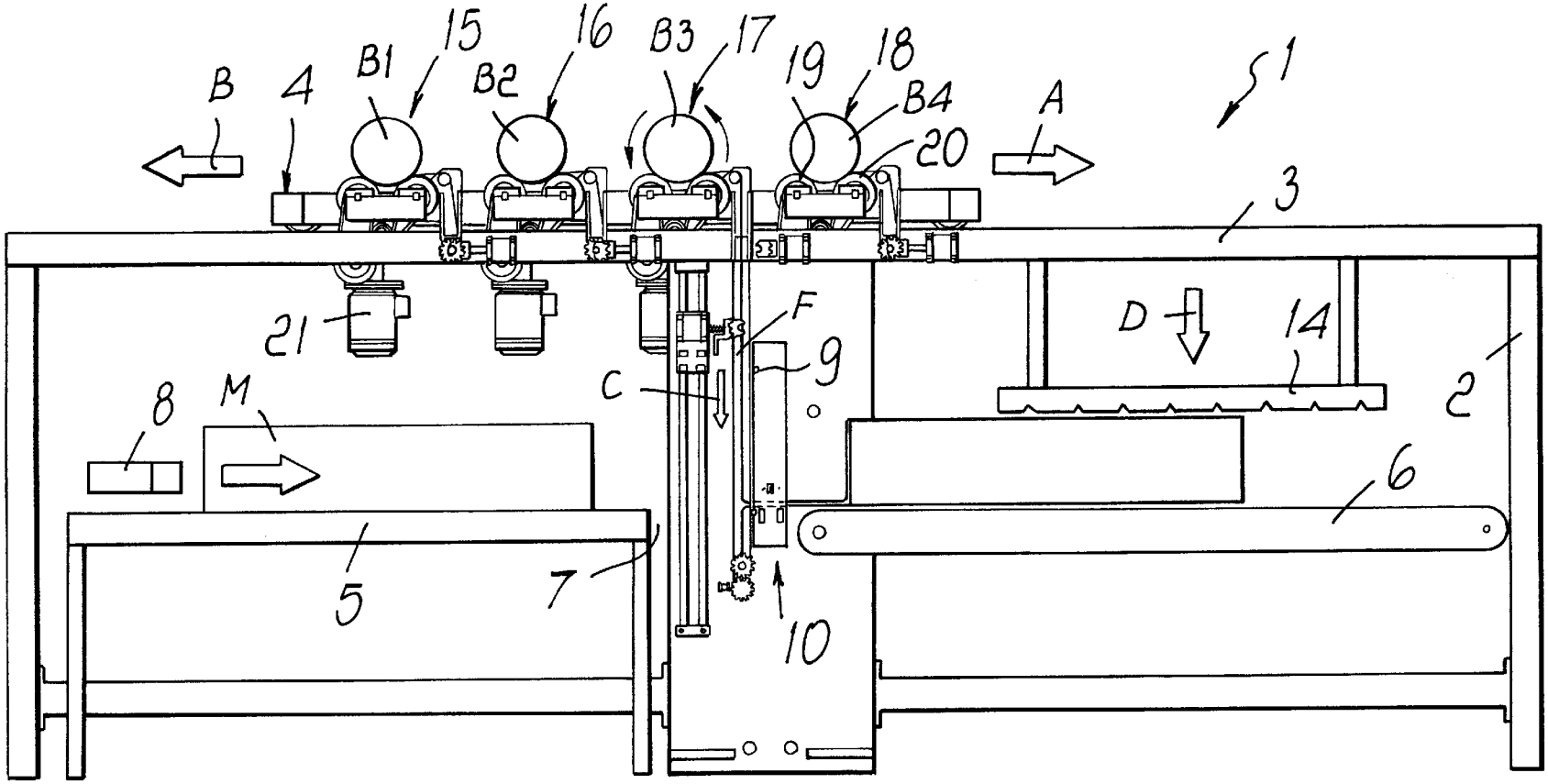
FIG. 1 is a side elevation view of a mattress packaging machine, equipped with the device according to the invention.

With reference to FIG. 1, the reference numeral 1 generally designates a machine for packaging mattresses, which comprises a frame composed of four posts 2 arranged at the corners of an imaginary rectangle and interconnected by cross-members and longitudinal members. In particular, the posts are connected at the top by longitudinal members which form two rails 3 for the sliding of a carriage 4 which is motorized so that it can move in both directions A and B.

The frame comprises a supporting surface 5 for a mattress M which is co-planar to a conveyor 6 for removal. A gap 7 remains between the outlet of the surface 5 and the conveyor 6, and the packaging sheet F is guided downward in the direction C at right angles to the surface 5 and to the conveyor 6. The mattress M, by means of a pusher 8 or the like, is pushed in the direction A against the sheet F which, by means of a guiding roller 9, is laid over and under the mattress M. When the mattress M, after moving beyond the gap 7, reaches the conveyor 6, the upper and lower flaps of the sheet F that lie upstream of the mattress are joined by a heat-sealing and cutting device 10 (FIG. 2) which is composed of two heat-sealing bars 11 and 12 which produce two heat-sealing lines which are parallel and spaced so as to allow a blade 13, arranged between them, to cut away the sheet.

In this manner, the heat-sealing line that lies downstream of the cut closes the sheet F, forming a ring which surrounds the mattress, while the heat-sealing line that lies upstream of the cut allows the sheet F to remain attached to the takeup roller arranged below the surface 5 in order to allow it to take up a portion whose length is sufficient to prevent the heat-sealing line from remaining in the portion of sheet used to package the following mattress.

After the mattress M, with the sheet F wrapped in a ring around it, has advanced onto the conveyor 6, two lateral heat-sealing units 14, actuated in the direction D, close it laterally so as to form a hermetic bag.

According to the invention, various roll supporting assemblies, fitted on the carriage 4, are provided for the automatic replacement of the roll from which the sheet is drawn both due to imminent depletion or due to the need to change the type of sheet used to package the mattresses. In the illustrated example, there are four assemblies 15, 16, 17 and 18, but there may be any number of such assemblies.

Each assembly comprises two rollers 19 and 20 which are rotatably supported on the carriage 4 and are motorized, by means of a chain drive, by a gearmotor 21 so as to turn the rolls B1, B2, B3, B4 in the direction E.

The sheet F that exits from the roll is diverted by a guiding roller 22 into a channel 23 formed by two vertical walls 24 and 25 which lie between the longitudinal beams 26 of the carriage 4.

Figure 3:
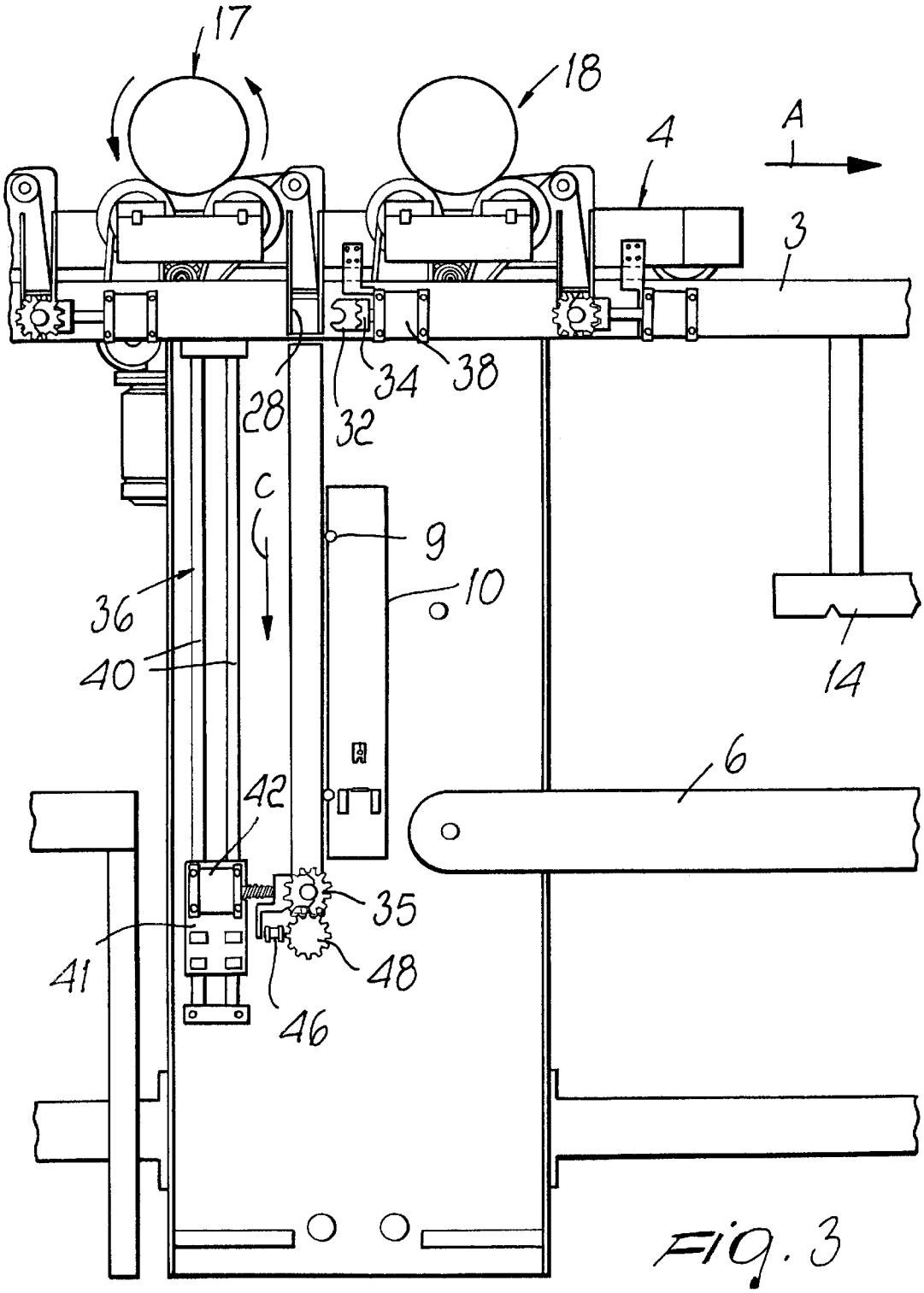
Figure 4:
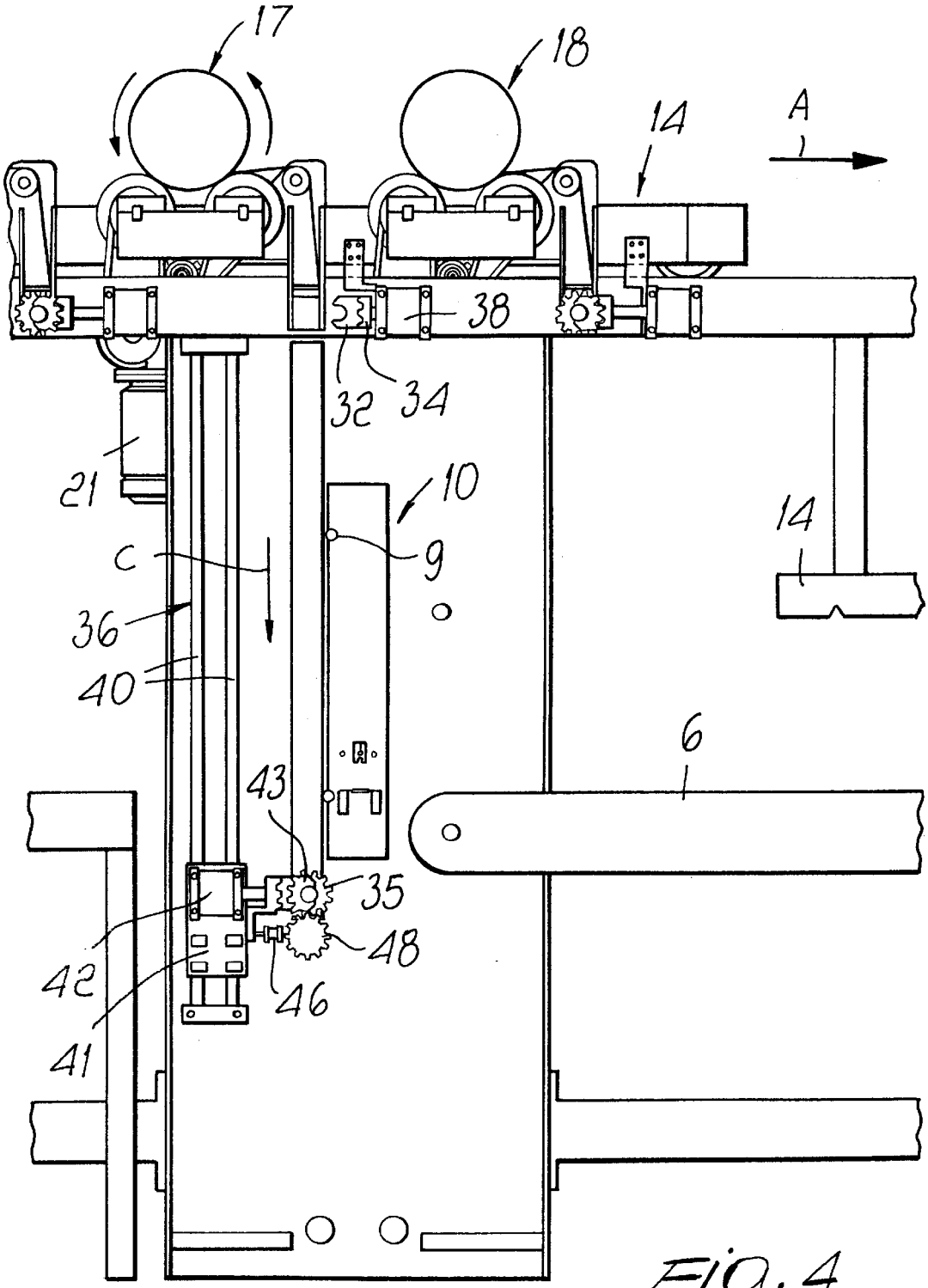

The outgoing sheet end is fixed to a takeup roll 27 whose axis is parallel to the axis of the roll from which it is unwound; the roll 27, in the inactive position of the assembly, is accommodated in a compartment 28 (FIG. 3) which is formed at the lower end of the channel 23.

Figure 6:
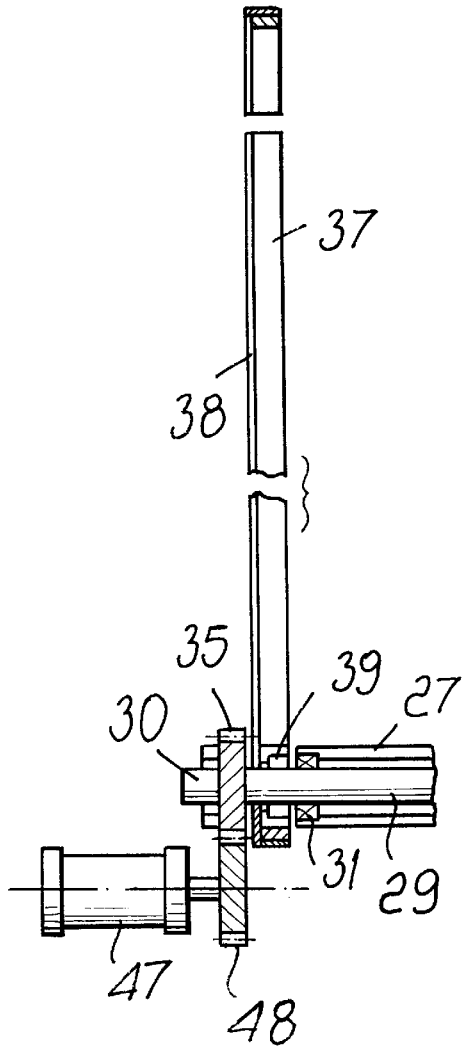
FIG. 6 is a sectional view, taken along the line VI—VI of FIG. 5.

The roll 27 is supported on a shaft 29 (see FIG. 6) whose mutually opposite ends form two pivots 30. The roll 27 can rotate about the shaft 29 only in one direction due to the presence of a freewheel mechanism 31, and is supported in the compartment 28 by two respective forks 32 which engage pivots 30 and are actuated horizontally by respective actuators 33. The actuators 33, by means of brackets 33*a*, are rigidly coupled to the longitudinal beams 26 of the carriage 4. The forks 32, when retracted by the actuators 33, disengage from the pivots 30, allowing the roll 27 to descend.

In the position in which the pivots 30 are engaged in the forks 32, the roll 27 is prevented from rotating by a toothed sector 34 (see FIG. 2) which is rigidly coupled to one of the forks and is adapted to mesh with a gear 35 which rotates rigidly with the roll 27.

At the gap 7 that separates the surface 5 from the conveyor 6 there is a transfer unit 36 (FIGS. 2 and 5) which lowers the roll 27, with the end of the sheet attached thereto, below the surface 5, so as to arrange the sheet F at right angles in front of the mattress M to be packaged.

The transfer unit 36 is composed of two mutually opposite C-shaped vertical guides 37 whose upper ends are fixed under the rails 3 and which extend below the surface 5. The guides 37 lie on a vertical plane which lies upstream of the heat-sealing device 10 and is adjacent thereto.

The guides 37 have two longitudinal slots 38 for sliding, through which the pivots 30 protrude outward.

In order to guide the roll 27 along the guides 37, there are bearings 39 which are mounted on the shaft 29 and can slide in the channels formed by said guides.

Upstream of each guide 37 there is a further guide which is composed of a pair of parallel and vertical bars 40.

Two respective sliders 41 can slide on the bars 40, and respective actuators 42 are fixed thereon.

The actuators 42 actuate respective forks 43 which, in the raised position of the sliders 41, are adapted to engage the pivots 30, disengaging from the forks 32.

A sector 44 is rigidly coupled to a fork 43, as provided for one of the forks 32, and is adapted to mesh with the gear 35 of the roll 27 so as to lock its rotation.

The toothed sector 44 is provided with an arm 45 which, in the lowered position of the sliders 41, i.e., at a level that lies below the supporting surface of mattress M, is capable of activating a sensor 46 for actuating a motor 47 which actuates a pinion 48 with which the gear 35 meshes in the lowered position.

The sliders 41 are actuated between the raised position for the alignment of the forks 43 with the forks 32 and the lowered position for the meshing of the gear 48 with the gear 35 by means of an actuation assembly which is not shown but can be easily envisioned. For example, the assembly can be constituted by a vertically arranged chain which has a point which is rigidly coupled to a slider 41 and is motorized by a gearmotor.

The operation of the apparatus is as follows.

Assume one wishes to package a mattress M, which lies on the surface 5, with a sheet F taken from the roll B3 (see FIG. 1).

For this purpose, the carriage 4 is arranged on the rails 3 so that the assembly 17 arranges the compartment 28 of the channel 23, in which the roll 27 is accommodated, so that it lies above the guides 38, rests within the forks 32 and is rotationally locked upon engagement of the toothed sector 34 in the gear 35. The sliders 41 that support the actuators 42 are raised to the top of the bars 40 with the forks 43 aligned horizontally to the pivots 30 of the shaft 29 but are disengaged therefrom.

Figure 2:
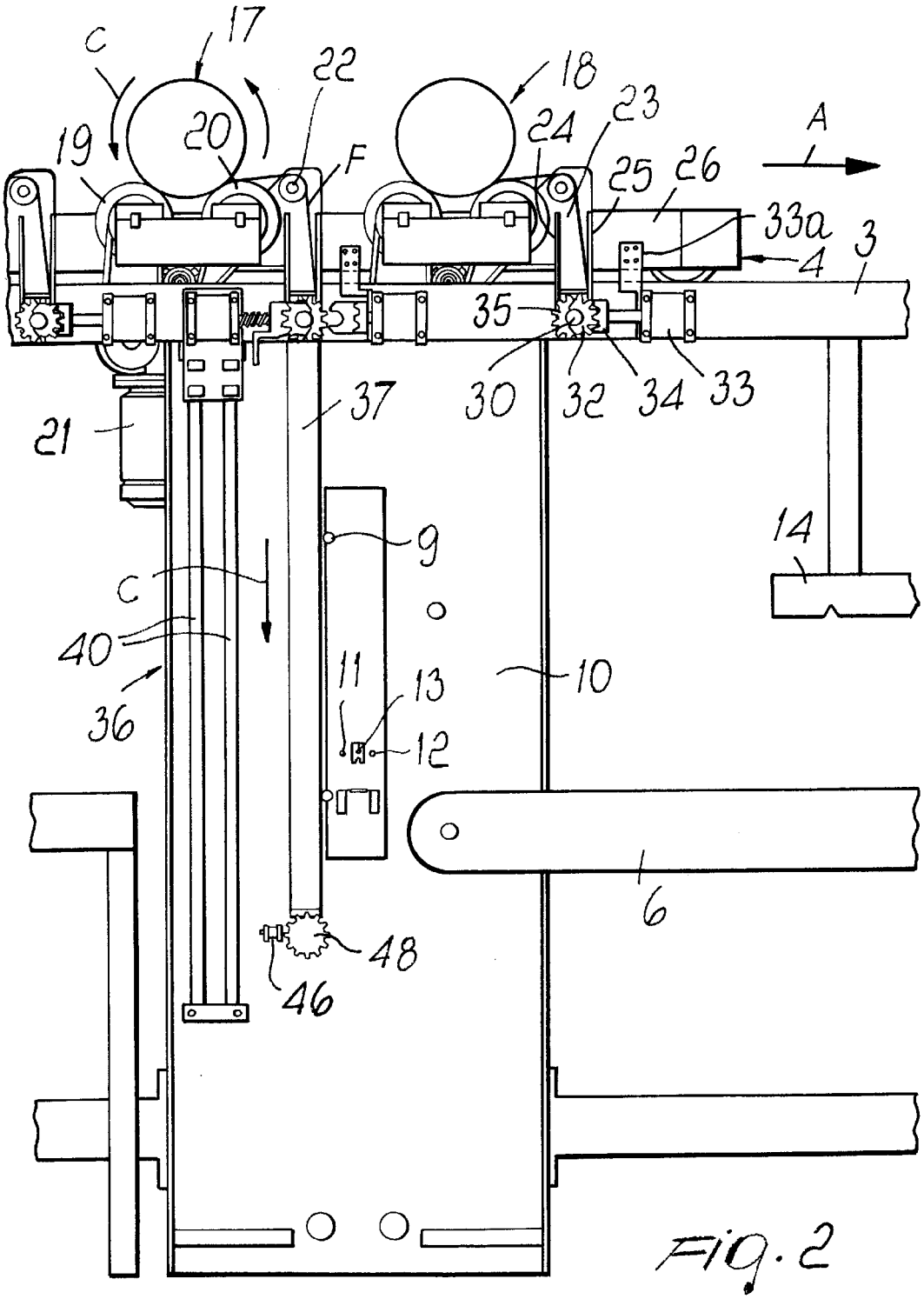
FIGS. 2, 3 and 4 are views of a detail of the device in three different operating conditions.
Figure 5:
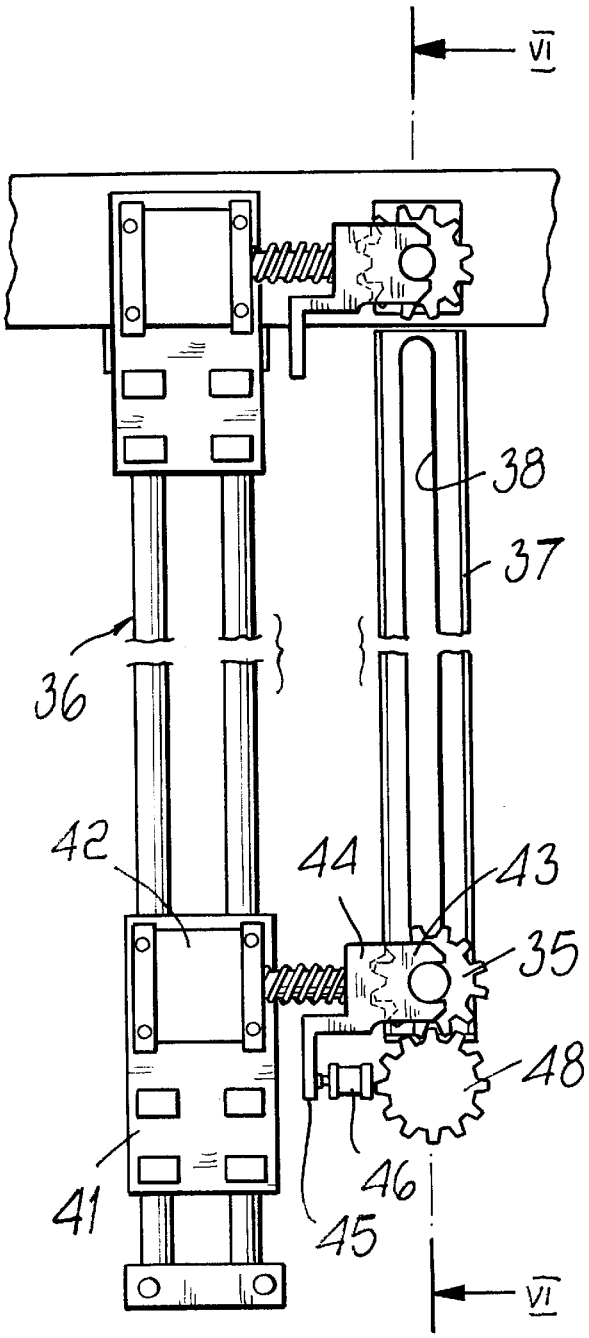
FIG. 5 is an enlarged-scale view of the detail of FIGS. 2 to 4.

At this point, by activating the actuators 33 and 42, the forks 32 are retracted from the pivots 30, while the forks 43 are made to advance so as to transfer the support of the pivots 30 from the forks 32 to the forks 43 (see FIG. 2 and FIG. 5). The sector 44 prevents the rotation of the roll 27 and keeps the gear 35 in the angular orientation provided in order to ensure meshing with the pinion 48.

Figure 7:
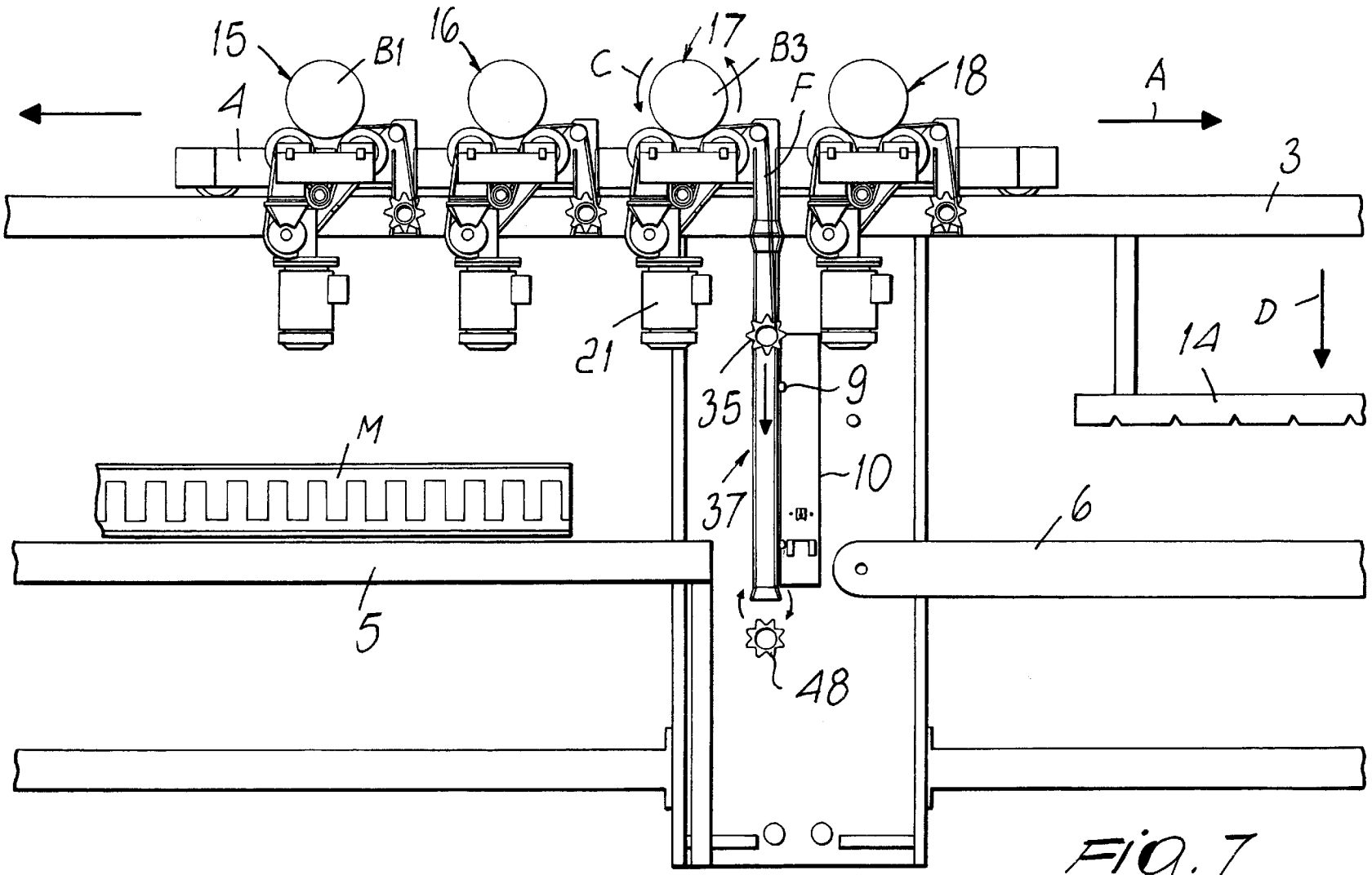
FIGS. 7, 8 and 9 are views of the machine in three successive steps of packaging.
Figure 8:
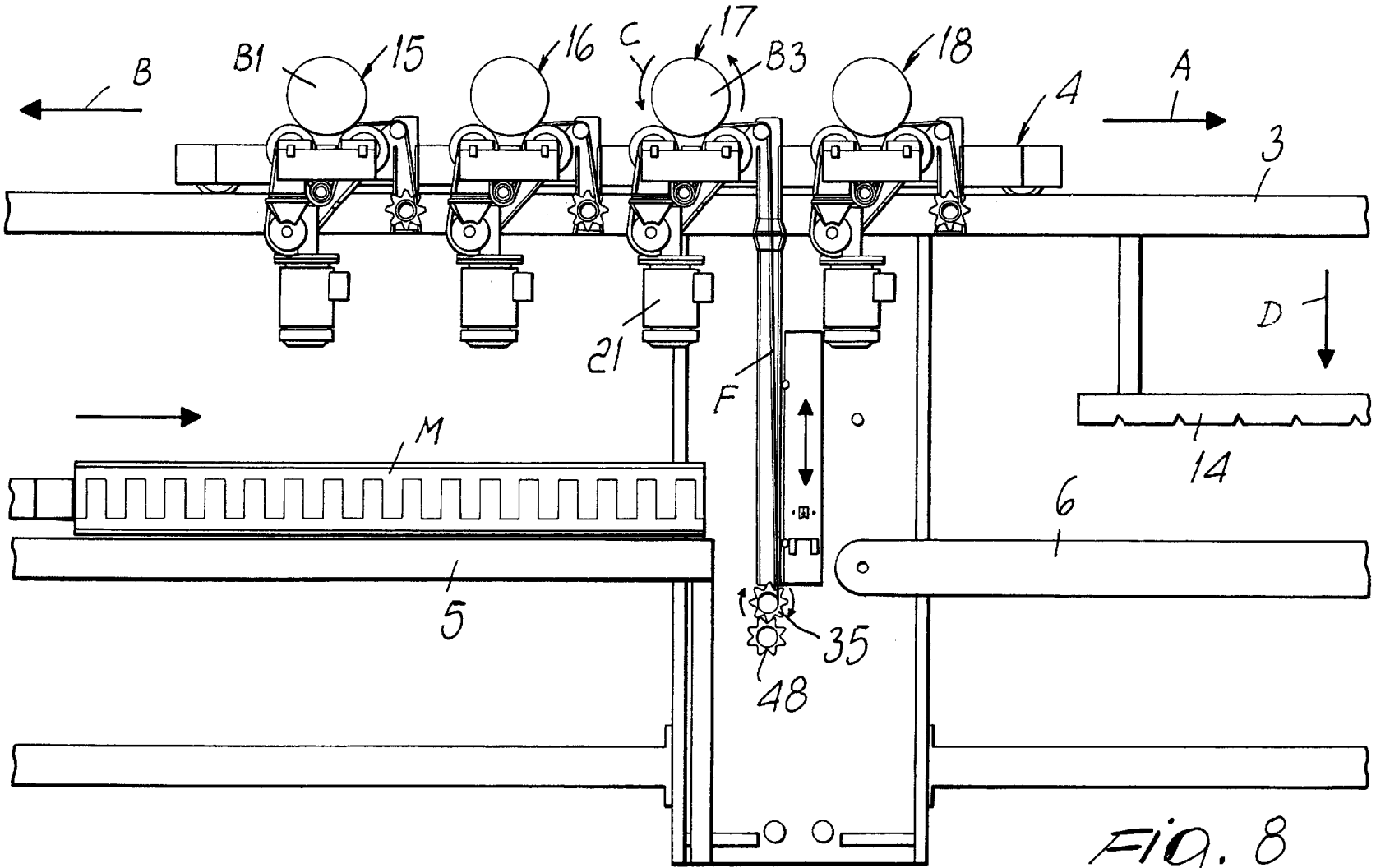

Once this step has been completed, the gearmotor 21 is activated and, by actuating the rollers 19 and 20, produces the rotation of the roll B3 in the direction E for the unrolling of the sheet F. At the same time, the descent of the sliders 41 is actuated so that the roll 27, no longer retained by the forks 32, can descend along the guides 38 (see FIG. 7) until it reaches the lower position, below the surface 5 (see FIG. 8), at which the gear 35 meshes with the pinion 48 and the sensor 46, activated by the arm 45, activates the motor 47 (see FIG. 5).

The actuation of the motor 47, by means of the gear 48, 35, turns the shaft 29 and, by means of the freewheel mechanisms 39, the roll 27. The actuation of the motor 42 is timed so that only a given portion of the sheet F is wound onto the roll 27. Such winding allows, at the end of each packaging step, and specifically after the sheet has been closed in a ring and cut, to take up the end portion of the sheet that has the unsightly heat-sealing line, as will become apparent hereinafter, and tension the sheet F so that it is perpendicular to the surface 5.

Figure 9:
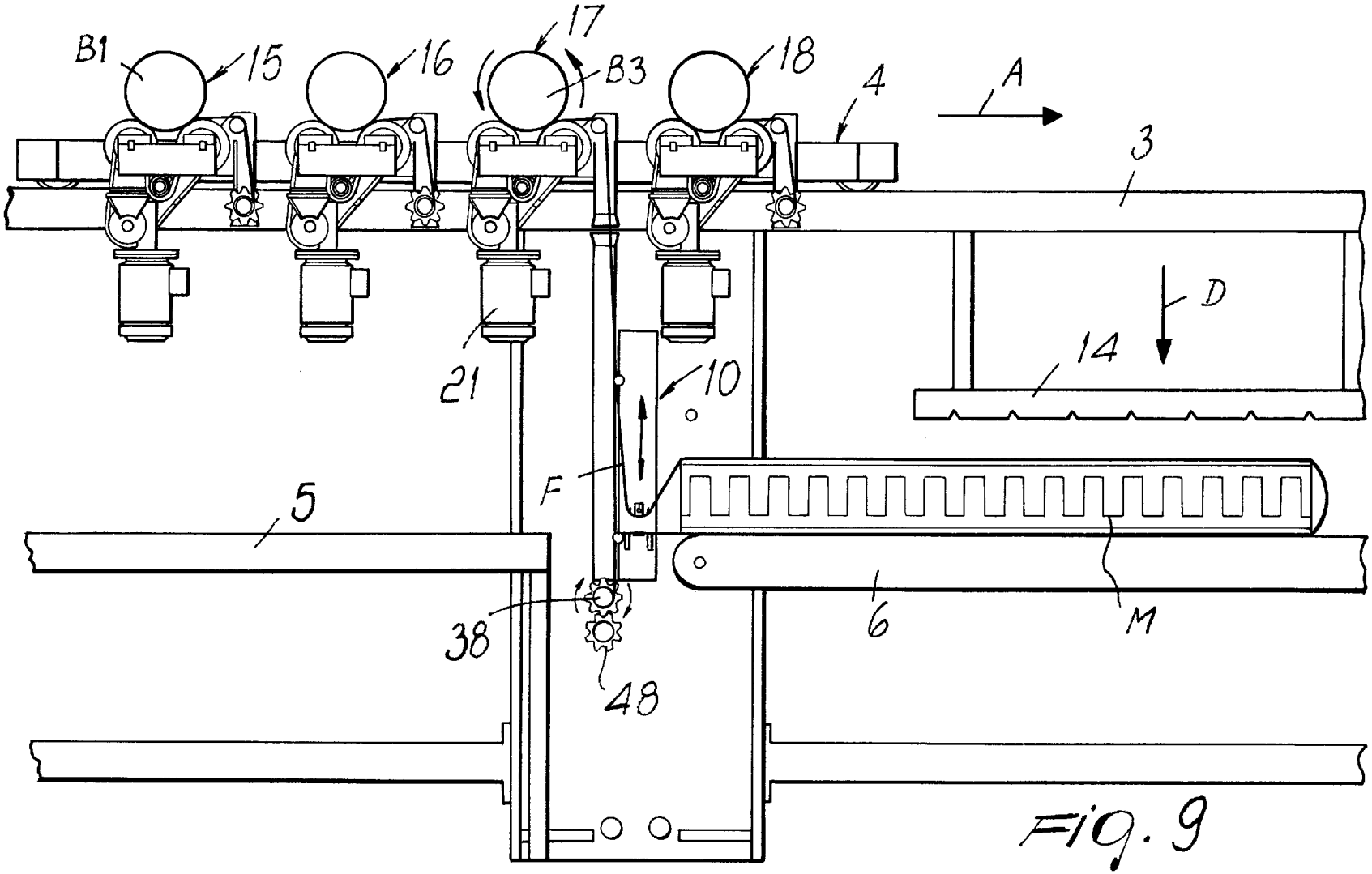

By then making the mattress M advance along the surface 5 while keeping the motor 47 locked, the sheet F is applied over and under the mattress M (see FIG. 9) and then closed in a ring-shaped configuration by the heat-sealing and cutting device 10. Conveniently, the feeding of the sheet F and its arrangement around the mattress M are facilitated by actuating the gearmotor 21 in the direction for the unwinding of the roll B3 so as to prevent the mattress from applying excessive traction to the sheet.

By opening the heat-sealing and cutting device 10, the packaged mattress can advance further along the conveyor 6, while by way of the heat-seal provided upstream of the cut, the sheet F maintains its vertical continuity, so that by actuating the motor 47 it is possible, as mentioned, to take up a small portion thereof which corresponds to the waste and comprises the heat-sealing line S.

The apparatus is thus restored to its initial position, ready to work on a new mattress.

If the roll B3 is about to end or if one wishes to replace it with another one, for example with the roll B1, for other reasons, one proceeds by lifting the sliders 41 and by turning in the opposite direction the gearmotor 21 so as to take up the portion of sheet F that runs from below the surface 5 up to the compartment 28.

After the roll 27 has entered the compartment 28, the actuators 42 and 33 are activated so as to disengage the forks 43 from the pivots 30 and at the same time transfer the pivots 30 into the forks 32. The roll 27 thus remains suspended from the carriage 4. After lowering the sliders 41 to such a level as to not hinder the movement of the carriage 4, the carriage is moved until the compartment 28 of the assembly 15 for supporting the roll B1 lies in alignment with the guides 37. The subsequent steps of operation comprise the lifting of the sliders 41 until the forks 43 reach the level of the pivots 30, so that by actuating the actuators 42 it is possible to transfer the support of the roll 27 to the forks 43. Once the transfer of the roll 27 onto the forks 43 has been completed, the sliders 41 are lowered and the operating steps are repeated as described above.

It should be noted that the freewheel mechanisms 39 allow, on the one hand, the rotation of the roll 27 on the shaft 29 in the direction for taking up the waste and, on the other hand, allow to rotationally lock the roller 27 so as to allow the unwinding of the sheet F from the roll.

Attention is also drawn to the locking action applied by the toothed sectors 34 and 44 which, by preventing the gear 35 from turning during the lifting and lowering of the sliders 41, maintains the angular orientation of the gear 35 and ensures its meshing with the pinion 48 upon any roll change.

The described device is susceptible of numerous modifications and variations, all of which are within the scope of the same inventive concept. In particular, the movement of the sliders 41 can be provided by means of a hydraulic cylinder or by means of a system which has, instead of one of the bars 40, a threaded rod actuated by a gearmotor.

The disclosures in Italian Patent Application No. BO99A000560 from which this application claims priority are incorporated herein by reference.

What is claimed is:

1. A mattress packaging machine including an automatic roll replacement device for automatically replacing a roll for feeding a sheet by means of which a mattress or the like is wrapped in said mattress packaging machine, comprising:

a frame provided with a horizontal surface for supporting said mattress such that said mattress may slide over said horizontal surface in an advancement direction of said mattress;

means for guiding said sheet transversely to said surface so that by moving said mattress over said surface in said advancement direction against said sheet, said sheet is arranged over and under said mattress;

means for joining and cutting said sheet upstream of said mattress with respect to said advancement direction with two parallel joining lines and in order to cut said sheet between said joining lines, so that with respect to said advancement direction the joining line that lies downstream of said cut closes in a ring-like configuration said sheet around said mattress and the joining line that lies upstream of said cut with respect to said advancement direction forms an end flap of said sheet;

said device comprising a carriage which can slide on guides which surmount said surface and extend in said advancement direction such that said carriage is selectively movable in said advancement direction;

a plurality of feed roll supporting assemblies which are installed in said carriage such that said feed roll supporting assemblies selectively move in said advancement direction when said carriage selectively moves in said advancement direction;

each one of said assemblies being provided with means for the unwinding and takeup of a respective sheet and with supporting elements for a take-up roll with which an end of said sheet is associated;

transfer means which are arranged upstream of said joining and cutting means with respect to said advancement direction and which comprise elements for picking up and retaining said take-up roll, said transfer means comprising means for moving said picking up and retaining elements between a raised position, at which said picking up and retaining elements pick up said take-up roll of an assembly arranged along said guides, and a lowered position, at which said take-up roll that has been picked up lies below said surface for supporting the mattress; and means for the actuation of said take-up roll which, in said lowered position and after the cut has been performed between said joining lines, actuate the takeup of said end flap of said sheet onto said take-up roll.

2. The mattress packaging machine with automatic roll replacement device according to claim 1, wherein said take-up roll is mounted, so that it can rotate unidirectionally, on a shaft, and wherein said elements for supporting the take-up roll of each assembly comprise a pair of forks which are actuated by respective actuators between a position for the engagement of the opposite ends of said shaft and a position for disengagement from said ends and release said ends onto said retaining elements of said transfer means.

3. The mattress packaging machine with automatic roll replacement device according to claim 2, wherein said transfer means comprise two first vertical guides which are arranged upstream of said joining and cutting means with respect to said advancement direction and are adapted to slidingly receive the opposite ends of said shaft and a pair of second guides on which respective sliders can slide, said sliders being designed to support said pick-up and retaining elements, means being provided for the actuation of said sliders between a raised position for picking up said take-up roll released by said forks and a lowered position below said matress supporting surface, at which said take-up roll is actuated so as to take-up said end flap after cutting said sheet between said joining lines.

4. The mattress packaging machine with automatic roll replacement device according to claim 3, wherein said pick-up elements comprise two forks which are supported on said sliders and are actuated by respective actuators in order to engage the opposite ends of said shaft in said raised position of said sliders, said forks being adapted to retain said take-up roll in said lowered position and during the takeup of said end flap.

5. The mattress packaging machine with automatic roll replacement device according to claim 4, wherein a gear is rigidly coupled to one end of said shaft and is adapted to mesh, in said lowered position of said take-up roll, with a pinion which is keyed onto the shaft of an actuation motor.

6. The mattress packaging machine with automatic roll replacement device according to claim 5, wherein respective toothed sectors are rigidly coupled to said forks for supporting and picking up the take-up roll and are adapted to mesh with said gear in said raised and lowered positions of said sliders.

7. The mattress packaging machine with automatic roll replacement device according to claim 6, wherein said take-up roll is unidirectionally rotationally coupled on said shaft by means of a freewheel mechanism.

8. The mattress packaging machine with automatic roll replacement device according to claim 5, wherein an arm is rigidly coupled to a fork for supporting said take-up roll and activates a sensor which senses the position for the meshing of said gear with said pinion in said lowered position of said sliders and actuates the rotation of said pinion in the direction for winding said end flap onto said take-up roll.

9. The mattress packaging machine with automatic roll replacement device according to claim 3, wherein said take-up roll is supported so that it can rotate on said shaft by means of bearings which are guided in said first vertical guides.

10. The mattress packaging machine with automatic roll replacement device according to claim 1, wherein each one of said assemblies comprises two rollers for supporting a feed roll which are actuated by a gearmotor so as to unwind said sheet from said feed roll during the wrapping of said sheet around said mattress and so as to take up the sheet onto said take-up roll during the displacement of said take-up roll from said lowered position to said raised one.

* * * * *